US005247807A

United States Patent [19]

Jarman et al.

[11] Patent Number: 5,247,807

[45] Date of Patent: Sep. 28, 1993

[54] SALAD BAR WITH REPLACEABLE MODULAR REFRIGERATED CONDIMENTS CONTAINER

[75] Inventors: Ronnie T. Jarman, Jacksonville; Joseph E. Johnston, Maysville; Carl J. Padgett, Jacksonville, all of N.C.

[73] Assignee: Fiberglass International, Inc., Maysville, N.C.

[21] Appl. No.: 918,210

[22] Filed: Jul. 21, 1992

[51] Int. Cl.[5] ..... A47F 3/04; F25B 49/02

[52] U.S. Cl. ..... 62/227; 62/252; 62/458; 165/918; 312/236

[58] Field of Search ..... 62/458, 228.1, 227, 62/229, 457.1, 457.6, 457.9, 371, 246, 252, 249, 520, 516, 518, 519, 521, 253, 441, 443; 165/918, 919; 312/116, 236, 284

[56] References Cited

U.S. PATENT DOCUMENTS

| | | | |
|---|---|---|---|
| 1,831,861 | 11/1931 | Henney | 62/227 X |
| 2,607,204 | 8/1952 | Kleist | 62/443 X |
| 3,308,633 | 3/1967 | Kritzer, Jr. | 62/239 |
| 3,388,561 | 6/1968 | Parrott | 62/467 |
| 3,491,548 | 1/1970 | Christiansen | 62/255 |
| 3,832,862 | 9/1974 | Ingels | 62/458 X |
| 4,213,498 | 7/1980 | Vandenbossche | 165/136 |
| 4,407,143 | 10/1983 | Wolfe | 62/303 |
| 4,593,752 | 6/1986 | Tipton | 165/48.1 |
| 4,615,183 | 10/1986 | Juncos et al. | 62/306 |
| 4,782,665 | 11/1988 | Wolfe | 62/246 |
| 4,802,340 | 2/1989 | Johnson | 62/229 |
| 4,852,741 | 8/1989 | Van Benschoten | 206/558 |
| 4,856,579 | 8/1989 | Wolfe | 165/48.1 |
| 4,870,835 | 10/1989 | Wolfe et al. | 62/246 |
| 5,010,741 | 6/1991 | Gelatini | 62/246 |
| 5,117,649 | 6/1992 | Mangini et al. | 62/458 X |

FOREIGN PATENT DOCUMENTS

| | | | |
|---|---|---|---|
| 973994 | 11/1964 | United Kingdom | 62/458 |
| 2152648 | 8/1985 | United Kingdom | 312/116 |

OTHER PUBLICATIONS

Catalog listing issued by Randell, a Dover Industries company, 0520 S. Coldwater Rd., Weidman, Mich. 48893 re: Rancraft Production 9700 Series.

Catalog listing issued by Atlas Metal Industries re: Model WCM-3, pp. 7-8.

*Primary Examiner*—Harry B. Tanner

*Attorney, Agent, or Firm*—Richard E. Jenkins

[57] ABSTRACT

A modular (unitary) refrigerated condiments container is provided for use in a conventional restaurant-type salad bar. The modular refrigerated condiments container comprises a housing having a recessed cold pan in the top thereof and a removable condiment support plate for mounting above the bottom surface of the recessed pan. At least one upstanding wall extends across the recessed pan to divide it into two or more sections for enhanced cooling of condiment holders supported by the condiment support plate. A refrigeration condensing unit is provided and includes refrigerant-containing cooling coils in heat exchange communication with the recessed pan so as to cool the space defined between the recessed pan and the condiment support plate and thereby to cool the condiment holders supported by the condiment support plate. A temperature control circuit is connected to the refrigeration means mounted in the modular refrigerated condiments container to maintain the condiment holders and foodstuffs contained therein at a desirable cool temperature.

26 Claims, 4 Drawing Sheets

SALAD BAR WITH REPLACEABLE MODULAR REFRIGERATED CONDIMENTS CONTAINER

TECHNICAL FIELD

The present invention relates generally to refrigerated salad bars for maintaining the foodstuffs in condiment holders at a cool temperature, and more particularly, the present invention relates to an improved replaceable modular refrigerated condiments container having the ability to be quickly and easily replaced in a salad bar cabinet as the need arises.

RELATED ART

As is well known to those familiar with the restaurant business, self-service salad bars have become tremendously popular in restaurants. Generally speaking, the self-service salad bars are of two basic types. The first type of free-standing salad bar comprises a cabinet having a counter top provided with one or more openings therein which are fitted with one or more relatively shallow pans used to hold crushed ice. Food or condiments containers of assorted sizes are then placed in the ice so that the foodstuffs in the containers are maintained at a relatively low temperature to preserve the contents against premature spoilage.

The aforementioned salad bar has been in use for some time and suffers from a number of shortcomings which are well known to those familiar with the restaurant business. Not the least of the problems associated with the first type of salad bar is the high level of maintenance required to properly chill foodstuffs in this ice-type salad bar.

Consequently, a second type of salad bar has more recently been developed which incorporates a fixed refrigeration unit within the salad bar cabinet having an extended cooling coil positioned against the bottom of a cold pan or plate located beneath the foodstuff-filled condiment containers. Unfortunately, the cooling coil presents difficulties in maintaining a suitable controlled heat transfer relationship between the containers and the refrigerated plate or recessed pan and may result in the foodstuffs either freezing and/or becoming too warm.

A variation of the cooling coil chilled salad bar is disclosed in U.S. Pat. Nos. 4,406,143; 4,782,665; 4,856,579; and 4,870,835 which generally disclose providing the refrigerant lines underneath a condiment container top plate which is positioned above a corresponding recessed cold pan. This type of frost-top unit provides the pleasing aesthetic appearance of the condiment containers resting in a bed of ice. However, like the first type of salad bar described above, this type of salad bar also suffers disadvantages or problems which are well known to those familiar with the construction and use of self-service salad bars in restaurants.

A primary disadvantage of both types of salad bars is inherent in the fixed refrigeration system which becomes a significant liability when it requires repair. The salad bar must be removed from service for an extended period of time in order to effect repair of the refrigeration unit permanently mounted therein. Even more significantly, new federal environment protection regulations are about to become effective which will require the purchase of expensive equipment in order to service and/or repair the salad bar refrigeration unit on site in a restaurant or other food service establishment. Thus, the manager of a restaurant or other food service establishment utilizing self-service salad bars is subject to significant inconvenience and cost when the refrigeration unit therein requires servicing and/or repair.

Although there have been attempts to do so, the prior art fails to disclose a salad bar with a high efficiency and replaceable refrigerated condiments container. A truly workable and high efficiency replaceable refrigerated condiments container serves to minimize the time during which the salad bar is out of service during routine service and/or repair and provide for off-site service and/or repair as may be required in order to meet pending new federal environment protection regulations relating to freon refrigerant handling.

DISCLOSURE OF THE INVENTION

In accordance with the present invention, applicants provide a replaceable modular refrigerated condiments container particularly adapted for use in salad bars in restaurants and other food serving establishments. The modular condiments container comprises a housing defining a recessed pan in the top thereof and is adapted for easy removal from a salad bar cabinet. At least one upstanding wall extends across the recessed pan so as to divide it into two or more sections. A condiment support extends across the top surface of the housing and defines a plurality of apertures therein to support a corresponding plurality of condiment holders wherein the condiment holders are maintained in the space defined between the condiment support and the recessed pan of the housing. A portion of the condiment holders are positioned in each of the sections defined by the one or more upstanding walls within the recessed pan. Refrigeration means are mounted in the housing and include refrigerant-containing cooling coils in heat exchange communication with the recessed pan so as to cool the space between the recessed pan and the condiment support so as to consequently cool the condiment holders and the foodstuffs contained therein.

A temperature control circuit means is provided and operatively connected to the refrigeration means for maintaining the condiment holders at a desirable cool temperature to best preserve the foodstuffs contained therein.

It is therefore the object of the present invention to provide a high efficiency removable and replaceable modular refrigerated condiments container for use in free-standing salad bars of the type found in restaurants and other food service establishments.

It is another object of the present invention to provide a high efficiency lightweight and inexpensive modular refrigerated condiments container which is easy to install and remove from a salad bar cabinet.

It is another object of the present invention to provide a high efficiency lightweight and easily removable modular refrigerated condiments container which, when it becomes defective, can be easily removed and replaced with another modular refrigerated condiments container without requiring time-consuming and expensive on-site repair.

It is still another object of the present invention to provide a high efficiency lightweight and easily removable modular refrigerated condiments container which can be quickly removed from a salad bar cabinet when repair is required and returned to the factory so as to facilitate environmentally safe removal and repair of the unit.

It is yet another object of the present invention to provide an improved refrigerated salad bar wherein the cold pan and operatively connected refrigeration unit are constructed in a unitary container to facilitate ease of removal for servicing and/or repair and the installation of another modular unit for use during the off-site servicing and/or repair of the original modular refrigerated condiments container unit.

Some of the objects of the invention having been stated, other objects will become evident as the description proceeds, when taken in connection with the accompanying drawings described below.

BEST MODE FOR CARRYING OUT THE INVENTION

Figure 1:
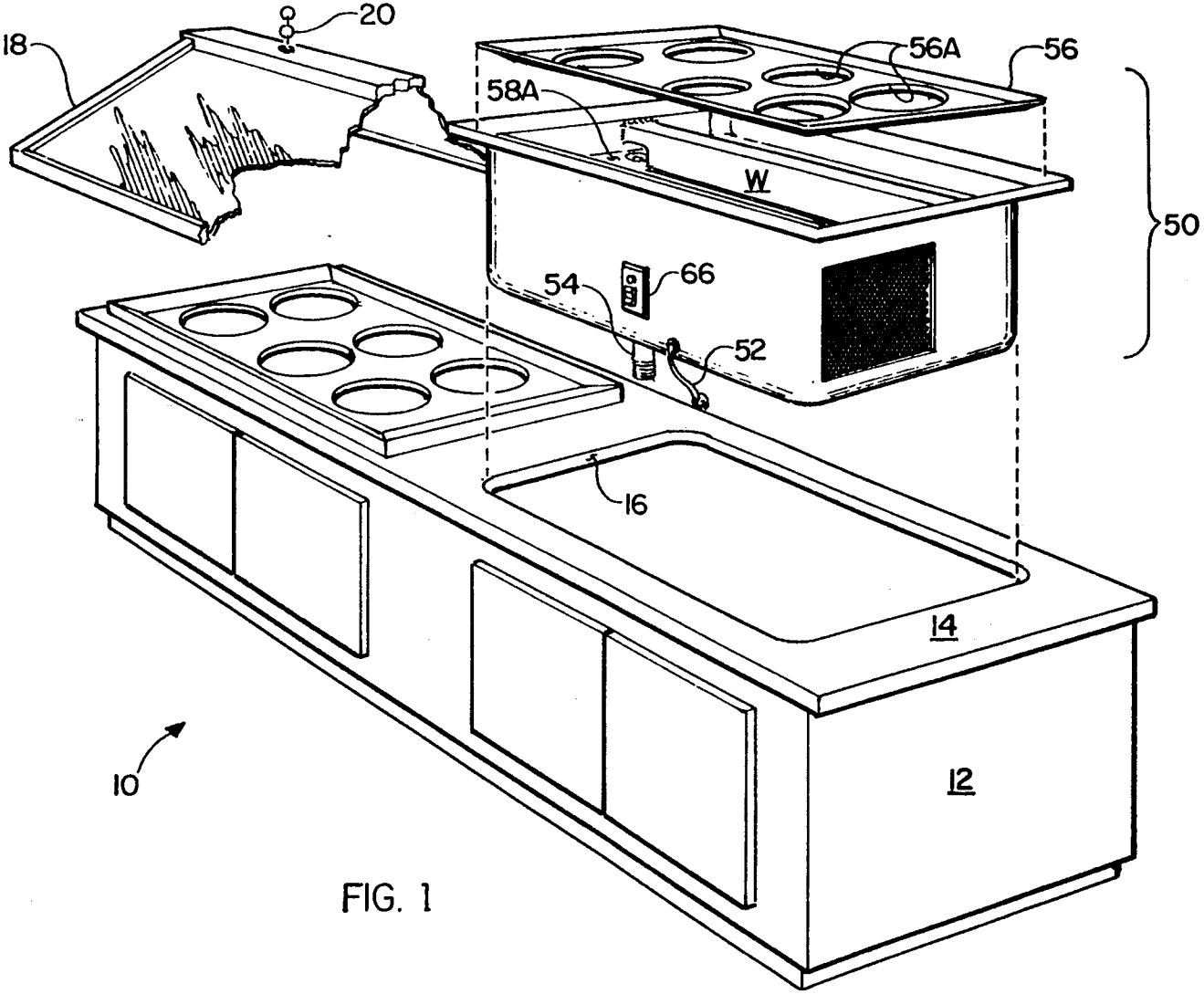
FIG. 1 is a perspective view of a refrigerated salad bar, having parts broken away for clarity, with the modular refrigerated condiments container shown in position for installation or removal from the salad bar cabinet.
Figure 2:
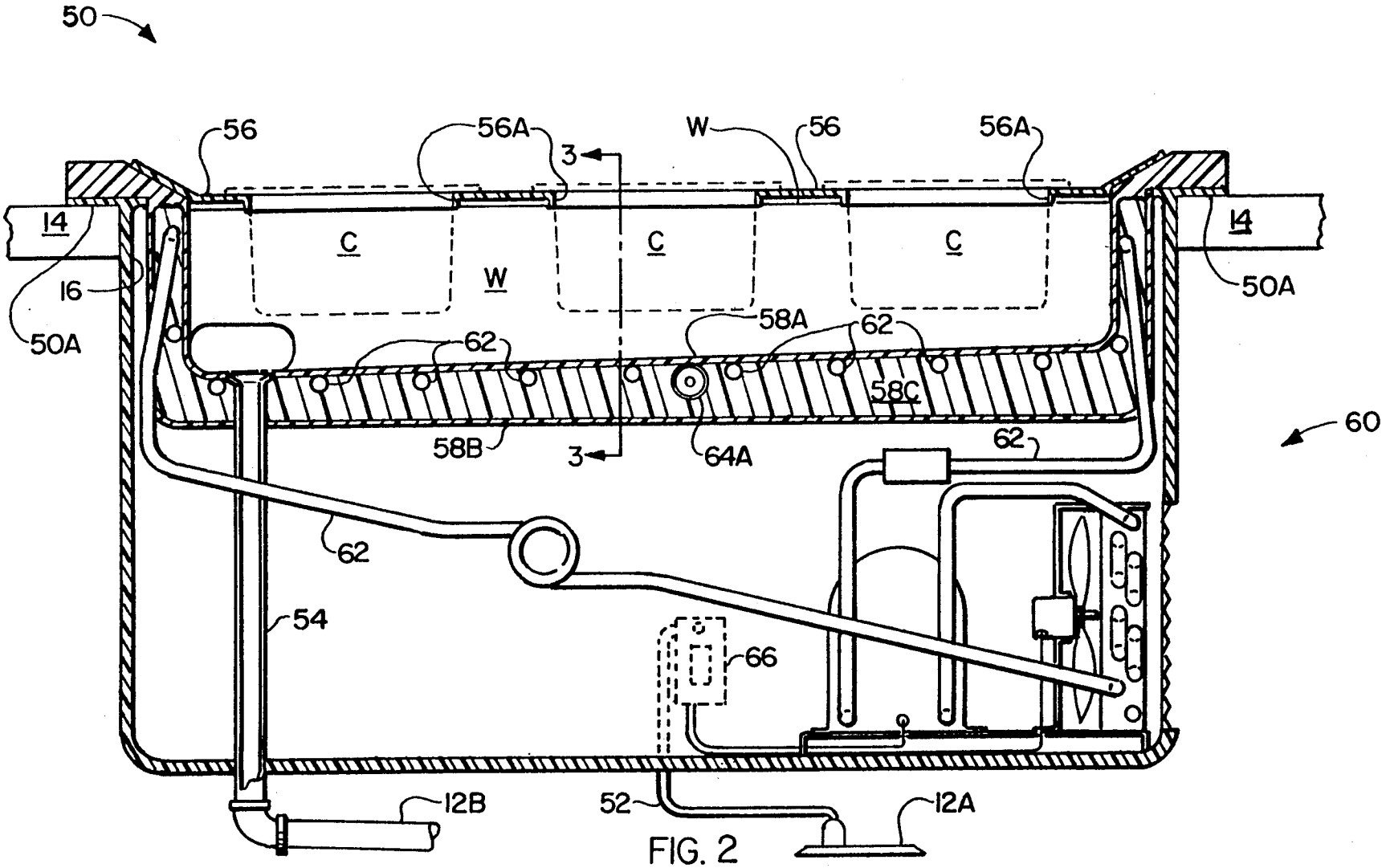
FIG. 2 is a vertical sectional view taken along the length of the modular refrigerated condiments container of the invention and further illustrating a portion of the salad bar cabinet in which the modular refrigerated condiments container resides.
Figure 3:
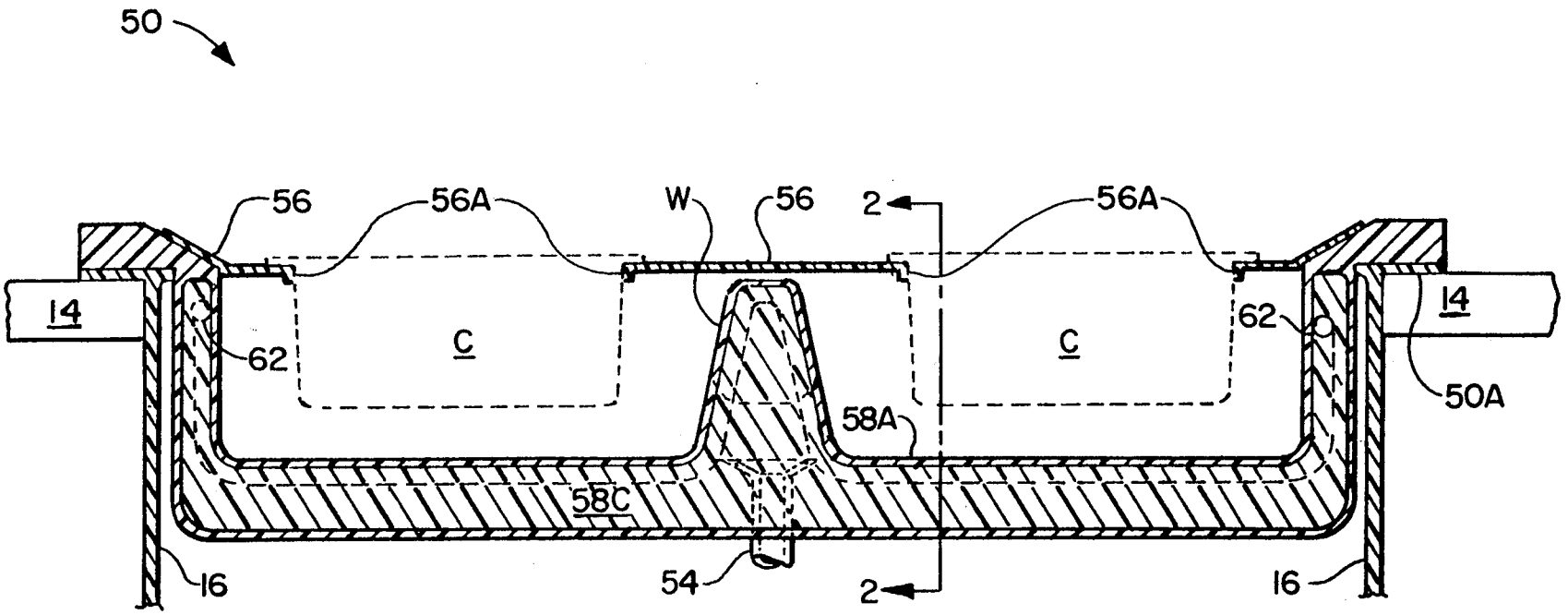
FIG. 3 is a vertical sectional view, in part, taken across the width of the modular refrigerated condiments container of the invention.

Referring now to the drawings, and initially to FIGS. 1-3 thereof, there is illustrated a salad bar, generally designated 10. Salad bar 10 includes an upstanding cabinet 12 and a counter top 14 defining one or more openings 16 in the top surface thereof. A transparent protective shroud 18 is suspended over the cabinet 12 by suitable means such as support chain 20. As will be appreciated by those familiar with the art, the construction of salad bar 10 described heretofore is entirely conventional and similar construction is used for both ice-cooled and refrigerant-cooled salad bars.

Removably positioned within opening 16 of salad bar 10 (as best seen in FIG. 1) is a novel modular refrigerated condiments container, generally designated 50. Refrigerated condiments container 50 is a unitary and self-contained refrigeration system for maintaining foodstuffs in condiment containers at a controlled cool temperature. As can be seen in FIGS. 1-3, refrigerated condiments container 50 can be easily installed by merely being placed into opening 16 of cabinet 12 and then simply plugging the electrical plug 52 into an electrical outlet 12A at or near the bottom of cabinet 12 and connecting fluid drain 54 to a suitable corresponding drain conduit 12B also located at or near the bottom of salad bar cabinet 12. For removal of refrigerated condiments container 50, electrical plug 52 and drain conduit 54 are quickly disconnected and container 50 then lifted out of counter top opening 16 of salad bar cabinet 12. Although the drawings only show condiments container 50 maintained in place by lip 50A thereof (see FIG. 2) which rests upon counter top 14, applicants contemplate that additional easily removable securement means such as screws or the like could be used to secure refrigerated condiments container 50 to counter top 14 of salad bar 10.

With reference now to the specific construction of refrigerated condiments container 50 which is shown in FIGS. 1-3, it can be seen that a condiment support plate 56 is removably mounted in the top thereof and defines a plurality of apertures therein designated 56A for removably retaining a corresponding plurality of condiment containers C indicated in phantom lines in FIGS. 2 and 3. As noted hereinabove, condiments container 50 defines an outwardly extending lip 50A around the perimeter thereof for overlaying and engaging the perimeter of opening 16 in salad bar 10. Refrigerated condiments container 50 has a recessed double wall pan 58 in the top thereof formed from outside surface wall 58A and inside surface wall 58B as best seen in FIGS. 2 and 3. Insulating foam 58C is provided between outside surface wall 58A and inside surface wall 58B.

An upstanding wall W extends lengthwise from one end of recessed pan 58 to the other and serves to better maintain condiment containers C at a desirable cool temperature than an undivided recessed pan 58. Applicants have discovered that one or more walls W may be provided in the lengthwise or widthwise direction, or both, of recessed pan 58. In one embodiment of the invention (not shown) each condiments container C would be positioned within a respective section of recessed pan 58 defined by a grid of upstanding walls W. Applicants have found that the use of one or more walls W to divide recessed pan 58 into sections results in a surprising (e.g., allows use of ¼ vs. ½ horsepower refrigeration unit) increase in cooling efficiency of condiments container 50.

A space is defined between double-walled recessed pan 58 and condiment support plate 56 into which condiment containers C downwardly depend so as to be cooled by the chilled ambient air in this closed space. Furthermore, a drain conduit, previously designated 54, extends downwardly from recessed pan 58 and through the bottom of refrigerated condiments container 50.

Figure 4:
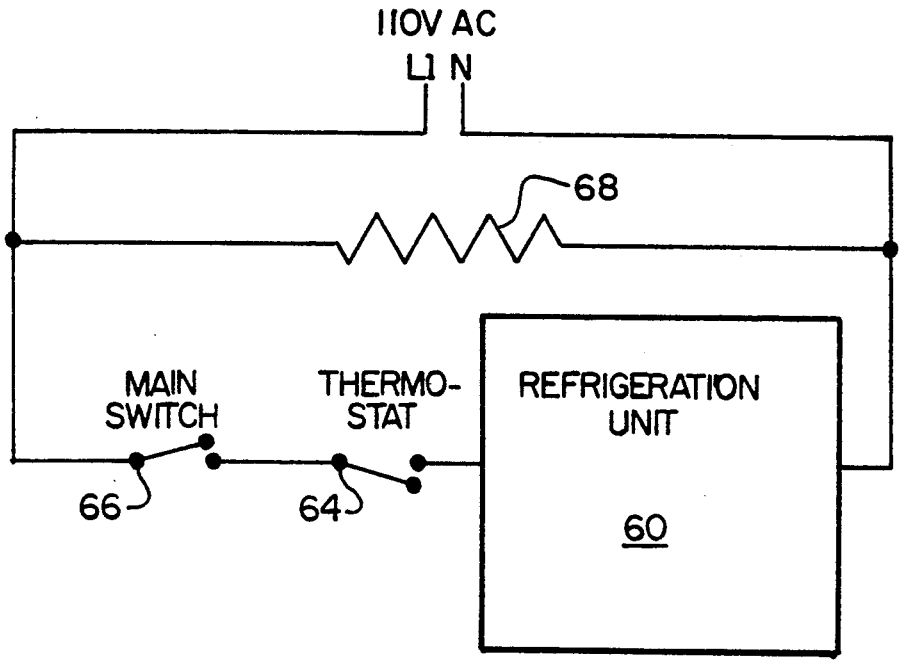
FIG. 4 is a simplified electrical schematic diagram illustrating the electrical circuit of the modular refrigerated condiments container.

Referring now to FIGS. 2-4, refrigerated condiments container 50 also includes a conventional refrigeration unit, generally designated 60. Although any suitable refrigeration condensing unit can be utilized, applicants have found the TECUMSEH brand Model No. AE13-60AA to be particularly effective in the practice of the instant invention. Refrigeration condensing unit 60 includes cooling coils 62 which extend between the double walls of recessed pan 58 and are secured by conventional means (not shown) to the underside of outside surface wall 58A in heat exchange relationship therewith. In this fashion, cooling coils 62 serve to maintain the ambient temperature in the area between recessed pan 58 and condiment support plate 56 at a controlled cooled temperature so as to also maintain condiment containers C and the foodstuffs therein at a controlled temperature in order to prevent spoilage. The thermometer of thermostatic switch 64 is also positioned adjacent the underside of outside surface wall 58A of recessed pan 58, and switch 64 is in electrical connection with refrigeration condenser unit 60 so as to assist in maintaining the temperature of the foodstuffs in condiment containers C at a controlled temperature.

Refrigeration condenser unit 60 is provided with a previously described electrical plug 52 which extends from the housing of refrigerated condiments container 50 so as to be easily plugged into a conventional previously described electrical outlet 12A in the bottom of cabinet 12 of salad bar 10. An electrical switch 66 is provided in order to open and close the electrical circuit from electrical plug 52 to refrigeration condenser unit 60. An optional feature contemplated by applicants for the preferred embodiment of the instant invention incorporates the use of a crankcase heater 68 (not shown in FIGS. 2 and 3 but designated in FIG. 4) in order to provide for a quicker initial start-up time of refrigeration condenser unit 60.

Although applicants contemplate that the modular refrigerated condiments container of the instant invention can be fabricated from many different types of material, it is presently believed that the preferred embodiment would be constructed from fiber-reinforced plastic (including condiment support plate 56) due to its relatively low cost, ease of maintenance, electrical insulation qualities, and light weight. The fiberglass-reinforced plastic may, as a matter of design choice, be molded in predetermined colors and coated with sanitary gelcoat available from American Colors of Orlando, Fla. as catalog product No. 88. Also, applicants contemplate the preferred embodiment of the instant invention to provide a suitable insulating foam 58C such as two pound density foam available from Foam Craft of Sarasota, Fla. as catalog product No. 2040.

It will be understood that various details of the invention may be changed without departing from the scope of the invention. Furthermore, the foregoing description is for the purpose of illustration only, and not for the purpose of limitation--the invention being defined by the claims.

What is claimed is:

1. A replaceable modular refrigerated condiments container for use in salad bars in restaurants and the like comprising:

a housing defining a recessed pan in the top thereof and adapted for easy removal from a salad bar cabinet;

at least one upstanding wall extending across said recessed pan so as to divide it into two or more sections;

a condiment support extending across the top surface of said housing and defining a plurality of apertures therein to support a corresponding plurality of condiment holders, said condiment holders being maintained in the space defined between said condiment support and the recessed pan of said housing, and a portion of said plurality of condiment holders being positioned in each of said sections defined by said at least one upstanding wall;

refrigeration means mounted in said housing and including refrigerant-containing cooling coils in heat exchange communication with said recessed pan so as to cool the space between said recessed pan and said condiment support and to thereby cool the condiment holders; and temperature control circuit means operatively connected to said refrigeration means for maintaining said condiment holders at a desirable cool temperature.

2. A modular refrigerated condiments container according to claim 1 wherein said housing comprises fiberglass-reinforced plastic.

3. A modular refrigerated condiments container according to claim 1 wherein said recessed pan comprises a double wall containing said cooling coils and foam insulation therebetween.

4. A modular refrigerated condiments container according to claim 3 wherein said cooling coils are secured adjacent the surface wall of said double wall recessed pan.

5. A modular refrigerated condiments container according to claim 1 wherein said condiment support comprises fiberglass-reinforced plastic.

6. A modular refrigerated condiments container according to claim 5 wherein said condiment support is freely removable from the top of said housing.

7. A modular refrigerated condiments container according to claim 1 wherein said refrigeration means comprises at least one electrically actuated refrigeration condenser unit and fluidly connected cooling coils.

8. A modular refrigerated condiments container according to claim 1 wherein said temperature control circuit means comprises at least one thermostatic switch having a thermometer positioned adjacent the bottom of said recessed pan.

9. A replaceable modular refrigerated condiments container for use in salad bars in restaurants and the like comprising:

a fiberglass-reinforced plastic housing defining a recessed pan in the top thereof and adapted for easy removal from a salad bar cabinet;

at least one upstanding wall extending across said recessed pan so as to divide it into two or more sections;

a removable fiberglass-reinforced plastic condiment support extending across the top surface of said housing and defining a plurality of apertures therein to support a corresponding plurality of condiment holders, said condiment holders being maintained in the space defined between said condiment support and the recessed pan of said housing, and a portion of said plurality of condiment holders being positioned in each of said sections defined by said at least one upstanding wall;

refrigeration means mounted in said housing and including refrigerant-containing cooling coils in heat exchange communication with said recessed pan so as to cool the space between said recessed pan and said condiment support and to thereby cool the condiment holders; and temperature control circuit means operatively connected to said refrigeration means for maintaining said condiment holders at a desirable cool temperature.

10. A modular refrigerated condiments container according to claim 9 wherein said recessed pan comprises a double wall containing said cooling coils and foam insulation therebetween.

11. A modular refrigerated condiments container according to claim 10 wherein said cooling coils are secured adjacent the surface wall of said double wall recessed pan.

12. A modular refrigerated condiments container according to claim 9 wherein said refrigeration means comprises at least one electrically actuated refrigeration condenser unit and fluidly connected cooling coils.

13. A modular refrigerated condiments container according to claim 9 wherein said temperature control circuit means comprises at least one thermostatic switch having a thermometer positioned adjacent the bottom of said recessed pan.

14. In a refrigerated salad bar of the type found in restaurants and the like comprising a cabinet with a counter top provided with one or more central openings having a refrigerated condiments container therein, the improvement comprising a replaceable modular refrigerated condiments container comprising a housing defining a recessed pan in the top thereof and adapted for easy removal from the salad bar cabinet; at least one upstanding wall extending across said recessed pan so as to divide it into two or more sections; a condiment support extending across the top surface of said housing and defining a plurality of apertures therein to support a corresponding plurality of condiment holders, said condiment holders being maintained in the space defined between said condiment support and the recessed pan of said housing, and a portion of said plurality of condiment holders being positioned in each of said sections defined by said at least one upstanding wall; refrigeration means mounted in said housing and including refrigerant-containing cooling coils in heat exchange communication with said recessed pan so as to cool the space between said recessed pan and said condiment support and to thereby cool the condiment holders; and temperature control circuit means operatively connected to the said refrigeration means for maintaining said condiment holders at a desirable cool temperature.

15. A refrigerated salad bar according to claim 14 wherein said housing comprises fiberglass-reinforced plastic.

16. A refrigerated salad bar according to claim 14 wherein said recessed pan comprises a double wall containing said cooling coils and foam insulation therebetween.

17. A refrigerated salad bar according to claim 16 wherein said cooling coils are secured adjacent the surface wall of said double wall recessed pan.

18. A refrigerated salad bar according to claim 14 wherein said condiment support comprises fiberglass-reinforced plastic.

19. A refrigerated salad bar according to claim 18 wherein said condiment support is freely removable from the top of said housing.

20. A refrigerated salad bar according to claim 14 wherein said refrigeration means comprises at least one electrically actuated refrigeration condenser unit and fluidly connected cooling coils.

21. A refrigerated salad bar according to claim 14 wherein said temperature control circuit means comprises at least one thermostatic switch having a thermometer positioned adjacent the bottom of said recessed pan.

22. In a refrigerated salad bar of the type found in restaurants and the like comprising a cabinet with a counter top provided with one or more central openings having a refrigerated condiments container therein, the improvement comprising a replaceable modular refrigerated condiments container comprising a fiberglass-reinforced plastic housing defining a recessed pan in the top thereof and adapted for easy removal from the salad bar cabinet; at least one upstanding wall extending across said recessed pan so as to divide it into two or more sections; a removable fiberglass-reinforced plastic condiment support extending across the top surface of said housing and defining a plurality of apertures therein to support a corresponding plurality of condiment holders therein, said condiment holders being maintained in the space defined between said condiment support and the recessed pan of said housing, and a portion of said plurality of condiment holders being positioned in each of said sections defined by said at least one upstanding wall; refrigeration means mounted in said housing and including refrigerant-containing cooling coils in heat exchange communication with said recessed pan so as to cool the space between said recessed pan and said condiment support and to thereby cool the condiment holders; and temperature control circuit means operatively connected to the said refrigeration means for maintaining said condiment holders at a desirable cool temperature.

23. A refrigerated salad bar according to claim 22 wherein said recessed pan comprises a double wall containing said cooling coils and foam insulation therebetween.

24. A refrigerated salad bar according to claim 22 wherein said cooling coils are secured adjacent the surface wall of said double wall recessed pan.

25. A refrigerated salad bar according to claim 22 wherein said refrigeration means comprises at least one electrically actuated refrigeration condenser unit and fluidly connected cooling coils.

26. A refrigerated salad bar according to claim 22 wherein said temperature control circuit means comprises at least one thermostatic switch having a thermometer positioned adjacent the bottom of said recessed pan.

* * * * *